United States Patent [19]

Stevenson

[11] 4,146,241

[45] Mar. 27, 1979

[54] ROLLER SKATE SNAP-ON WHEEL TRUCK

[76] Inventor: Richard L. Stevenson, 738 Loma Vista, El Segundo, Calif. 90245

[21] Appl. No.: 885,894

[22] Filed: Mar. 13, 1978

[51] Int. Cl.[2] ..... A63C 17/02

[52] U.S. Cl. ..... 280/11.27; 280/11.28

[58] Field of Search ..... 280/11.28, 11.27, 11.19

[56] References Cited

U.S. PATENT DOCUMENTS

| | | | |
|---|---|---|---|
| 309,254 | 12/1884 | Rust | 280/11.27 |
| 1,933,972 | 11/1933 | Dekome | 280/11.28 |
| 2,058,820 | 10/1936 | Pardon et al. | 280/11.28 |
| 2,127,630 | 8/1938 | Kees | 280/11.28 |
| 2,466,070 | 4/1949 | Balstad | 280/11.28 |
| 2,927,798 | 3/1960 | Jones et al. | 280/11.26 |

*Primary Examiner*—David M. Mitchel
*Attorney, Agent, or Firm*—Keith D. Beecher

[57] ABSTRACT

An improved roller skate assembly is provided in which the hanger bracket that is attached to the sole of the boot, and the trucks, or axle housings, which support the wheels, are preferably composed of a plastic material; and in which the trucks are attached to the hanger bracket by a snap-in relationship so as to simplify the manufacturing process.

4 Claims, 7 Drawing Figures

ROLLER SKATE SNAP-ON WHEEL TRUCK

RELATED APPLICATION

Ser. No. 402,254—Stevenson—filed Oct 1, 1973—"Plastic Roller Skate"—Art Unit 316—now abandoned.

BACKGROUND OF THE INVENTION

The present day prior art roller skate usually comprises a boot and a metal hanger bracket which is riveted, or otherwise attached to the bottom surface of the sole of the boot. Front and rear trucks for the wheels are then suspended from the hanger, and these are constructed to permit limited pivotal movement of the wheels about the longitudinal axis of the hanger, so as to allow the skater to execute turns and other exercises.

The prior art skates of the type described above are relatively complex, and they involve a relatively large number of mechanical assembly operations during this construction, all of which add materially to the cost of the end product.

In one embodiment of the present invention to be described, the hanger bracket is preferably composed of an appropriate plastic material, such as polyvinylchloride (PVC), or polycarbonate, and the trucks are preferably composed of a suitable high strength plastic, such as polycarbonate or nylon.

In another embodiment of the invention, also to be described, the hanger bracket is formed integral with the sole of the boot as a unitary plastic member. This latter construction further reduces the expense and complexity of the skate fabrication, and enables the boot, sole and hanger to be manufactured as a single unit, and the only action required is to snap in the truck axle housings to complete the construction of the skate.

All the complex mechanical manufacturing procedures of the prior art skates are eliminated in the construction of the assembly of the present invention, by providing for the trucks to be coupled to the hanger by a snap-action relationship with requires merely hand pressure to attach the trucks to the hanger.

The resulting combination of the present invention is a roller skate assembly which has all the strength and features of the prior art assemblies, and yet which may be manufactured and sold at a fraction of their cost.

DETAILED DESCRIPTION OF THE ILLUSTRATED EMBODIMENTS

Figure 1:
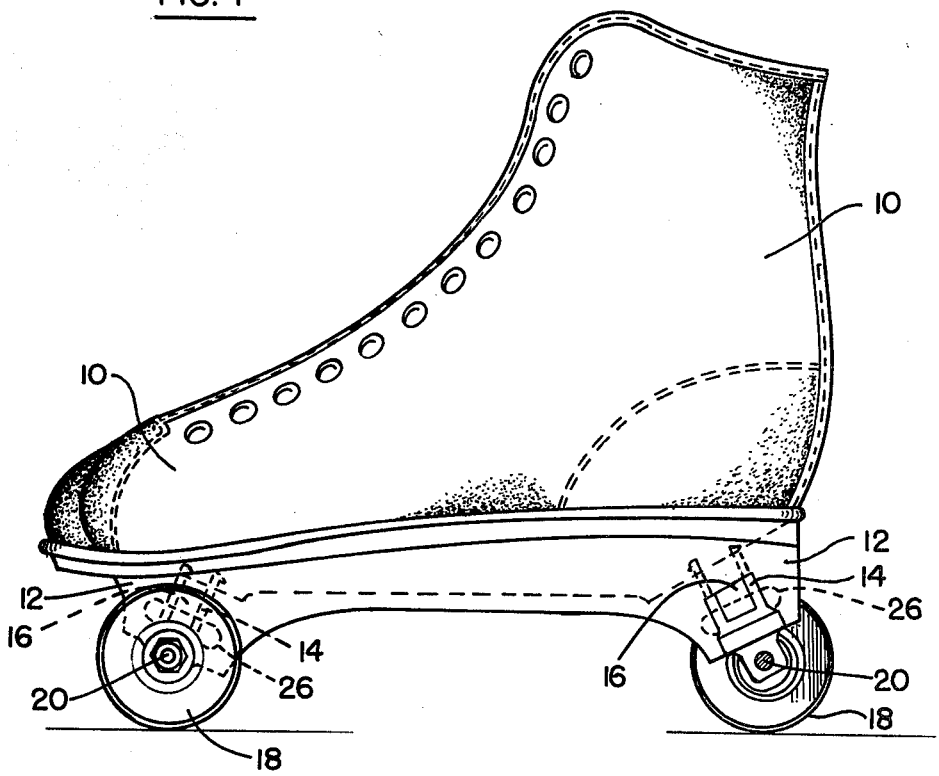
FIG. 1 is an elevational view of a boot-type roller skate which is constructed in accordance with the concepts of the present invention.

The skate represented in FIG. 1 comprises a boot 10 having a hanger 12 attached to the bottom of the sole of the skate. As mentioned above, the hanger 12 may be composed of an appropriate plastic material, such as PVC. It may be attached to the sole of the boot 10 by any appropriate means, or, if so desired, may be integral with the sole of the boot, as will be described in conjunction with FIGS. 6 and 7.

As shown, the hanger 12 defines sockets 14 at each end of the sole of the boot, and these sockets support trucks, such as the trucks 16. The trucks 16 may also be composed of plastic material, as mentioned above, and this material may be, for example, nylon, or other appropriate plastic having resilient characteristics. The wheels 18 of the skate are supported on axles 20 which, in turn, are supported by the trucks 16.

Figure 5:
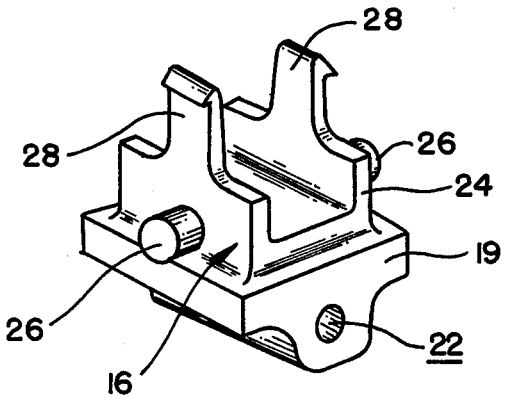
FIG. 5 is a perspective representation of one of the trucks.

The trucks 16 may have the configuration shown, for example, in the perspective representation of FIG. 5. Each truck, for example, has a base 19 with a passageway 22 extending through the base. The passageway 22 supports the axle 20 (FIG. 1) which, in turn, supports the wheels 18.

The trucks 16 also include a U-shaped bracket 24 which, for example, is formed integral with the base and which supports a shaft, or molded pivot projections 26. The bracket 24 has two arms 28 extending upwardly from its upper edge in essentially spaced and parallel relationship. The arms 28 have outwardly extending shoulders adjacent their upper extremities.

Figure 2:
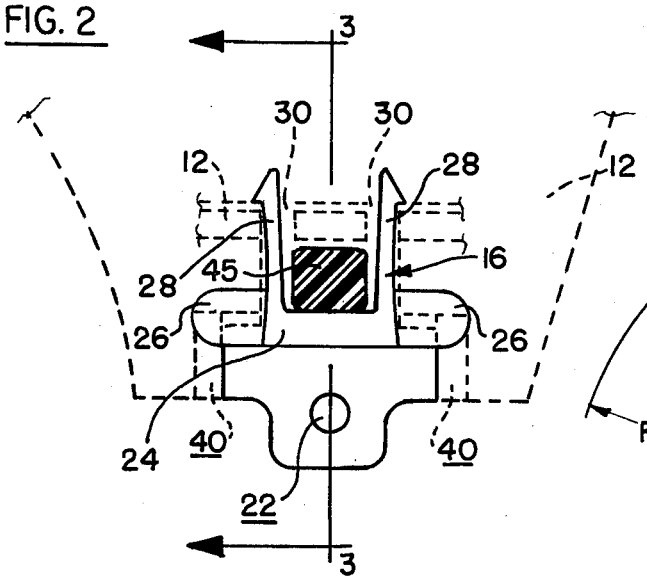
FIG. 2 is a section of one of the trucks which is supported on the hanger of the skate of FIG. 1.
Figure 3:
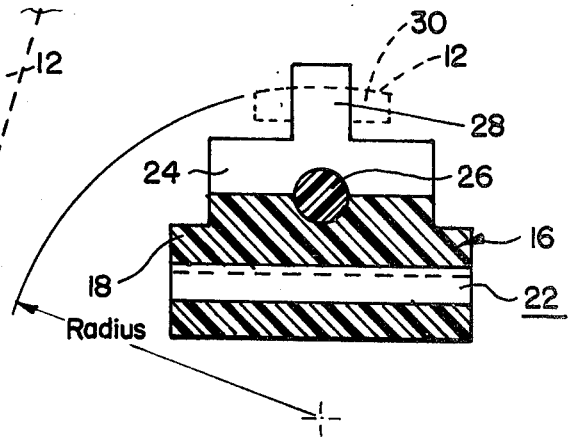
FIG. 3 is another section, taken essentially along the lines 3—3 of FIG. 2.
Figure 4:
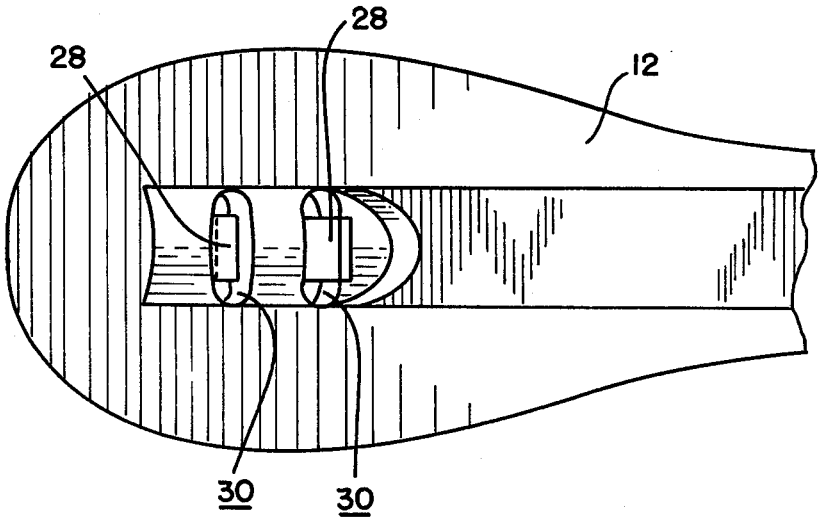
FIG. 4 is a top plan view of a fragment of the hanger bracket of the skate of FIG. 1.

As shown in FIGS. 2, 3 and 4, each truck 16 is inserted into the corresponding socket 14 until its arms 28 extend through slots 30 at the bottom of the socket (FIG. 4), so that the shoulders at the ends of the arms 28 extend over the edges of the slots to hold the trucks in the sockets. The molded pivot projections 26 of each truck are received in grooves 40 at the sides of the corresponding socket 14, and each projection 26 engages a journalling surface at the end of each groove. It will be appreciated that when the skate is in use, the resulting strain is borne by the projections 26 as they bear against the journalling surfaces at the ends of the grooves 40.

Each truck 16 is capable of limited pivotal movement about its molded pivot projections 26, so that the skater may properly manipulate his skate. It will be observed that the surface of the hanger 12 adjacent the arms 28, as shown in FIG. 3, is curved so as to permit the shoulders of the arms to move along the hanger surface without impediment, as the truck is pivotally turned about the shaft 26.

To assemble each truck 16 in its socket 14, it is merely necessary to slide the truck into the socket and, by hand pressure, force the arms 28 up into the slot 30, until their shoulders snap over the edges of the slots, to the position shown in FIG. 4.

A resilient snubber 45 is inserted between each truck and the corresponding hanger, as shown in FIG. 2. The snubber 45 provides a resilient shock absorbing relationship between the trucks adn the corresponding hangers, as well as its primary function of forcing the truck back to neutral or centered position after turns. The snubber is formed of any appropriate rubber-like material.

Figure 6:
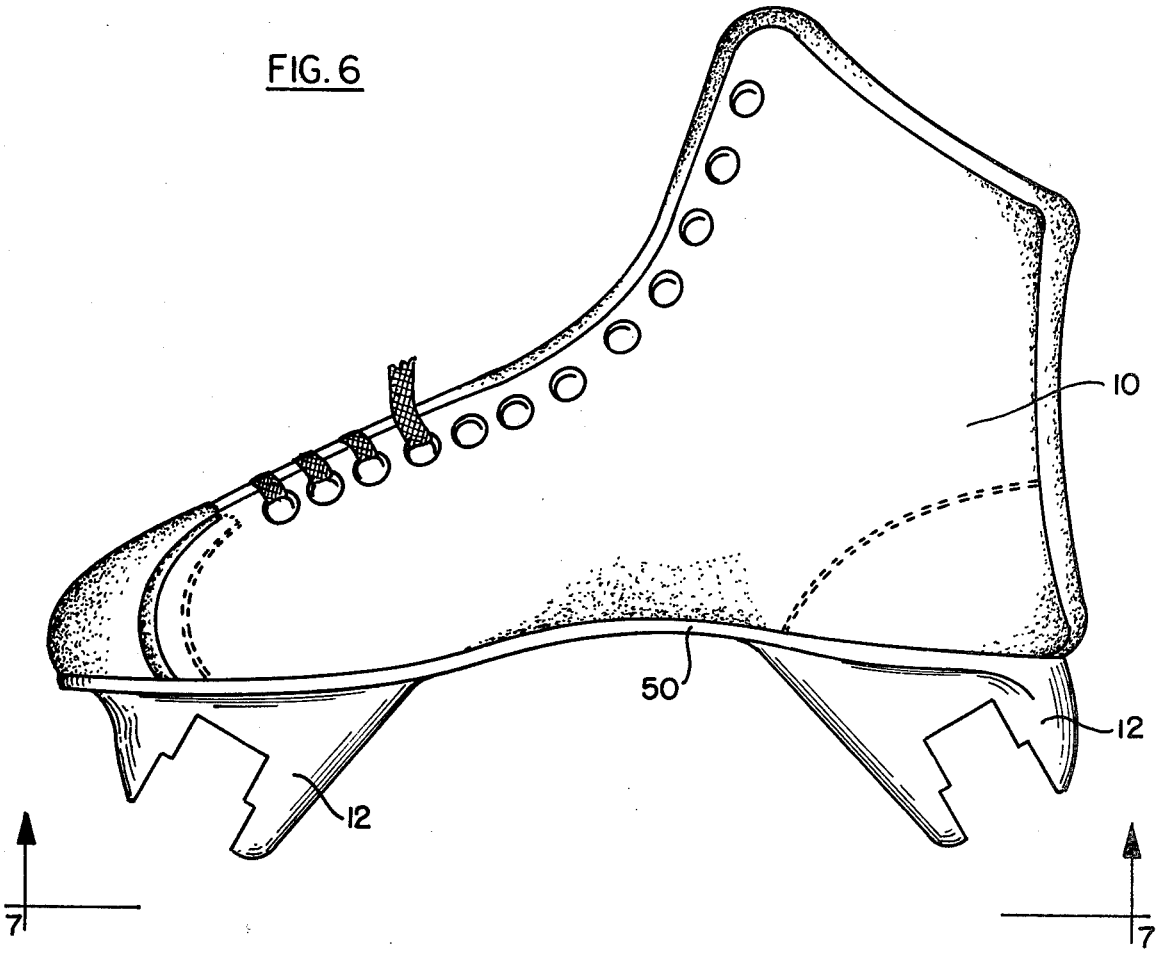
FIG. 6 is a side elevation of a boot having an integral plastic sole and hanger in accordance with a second embodiment of the invention.
Figure 7:
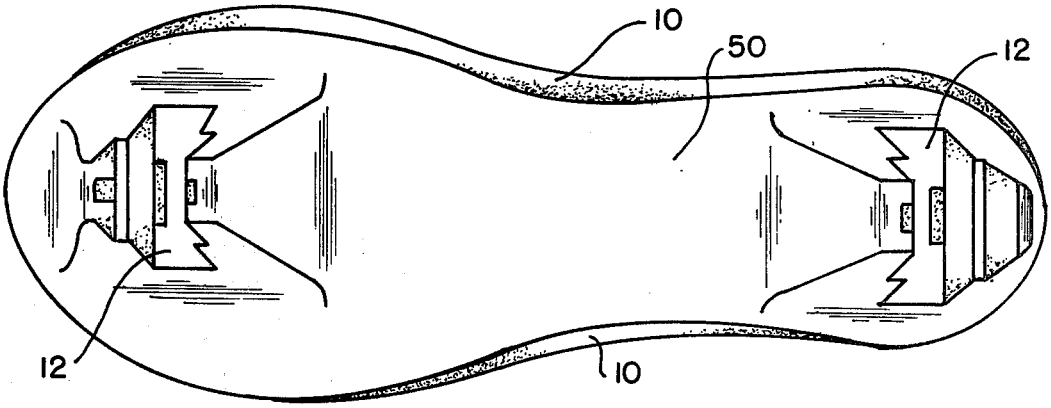
FIG. 7 is a bottom view of the assembly of FIG. 6, taken along the line 7—7 of FIG. 6.

As shown in FIGS. 6 and 7, the sole 50 of the boot 10 and the hangers 12 may be formed of a single plastic member composed, for example, of polyvinylchloride (PVC), or other appropriate plastic. The unitary assembly may be formed in any desired color to add attractiveness to the skate. The integral sole and hanger member may be attached to the boot during the manufacture of the boot, so that all that is necessary to form the skate is merely to snap in the trucks into the corresponding hanger.

The invention provides, therefore, a strong high quality and rugged skate assembly which is fabricated almost entirely of plastic, and which has all the features of the prior art assemblies, but which can be manufactured at a fraction of the manufacturing cost of the prior art assemblies, and sold at a lower price. The construction of the present invention has been found to reduce labor in the final assembly up to 50% or more. The trucks formed in accordance with the invention unlike existing metal riveted units, are easily replaceable. Also, the particular construction provides for a lowering of the center of gravity of the skate, as compared with the usual prior art skates, which increases the safety characteristics of the skate of the invention. When the integral construction of FIGS. 6 and 7 is used, for example, the hangers are molded at the extremities of the mold, regardless of the boot size, so that all sizes of skates will have the trucks mounted at the forward and rear extremities, as is desirable for safety of young or inexperienced skaters.

While particular embodiments of the invention have been shown and described, modifications may be made, and it is intended in the following claims to cover the modifications which come within the spirit and scope of the invention.

What is claimed is:

1. A roller skate comprising: a support bracket constructed to be affixed to the sole of a boot having an upper surface adjacent the sole and a lower surface defining downwardly opening sockets at each end of the sole, each of said sockets defining fore and aft grooves extending upwardly from the lower surface and each terminating at a journalling surface and further defining a pair of fore and aft spaced transverse slots extending upwardly through said upper surface; a pair of trucks respectively supported in said sockets, each of said trucks having a pair of spaced resiliently-biased arms extending transversely to the longitudinal axis of the sole and received in respective ones of said slots, said arms having shoulders at the extremities thereof which extend through said slots and which are outwardly biased into snap-action engagement with said upper surface at the edges of the slots, and each of the trucks having a shaft extending therefrom essentially parallel to the longitudinal axis of the sole received in said grooves and bearing against the journalling surface in the respective sockets for limited pivotal movement of the trucks about the respective axes of the shaft; an axle extending through each of the trucks transversely to the axis of the sole; and wheels mounted on the ends of each of said axles.

2. The roller skate defined in claim 1, in which said trucks are composed of a resilient plastic material.

3. The roller skate defined in claim 1, in which the sole and said support bracket are integrally formed of a plastic material.

4. The roller skate defined in claim 1, in which said support bracket is constructed of a plastic material to constitute the sole of the boot, and which includes a pair of hanger members formed integrally with the support bracket and extending downwardly therefrom to define sockets for the trucks at each end of the support bracket.

* * * * *